US009297209B1

(12) United States Patent
Smith et al.

(10) Patent No.: US 9,297,209 B1
(45) Date of Patent: Mar. 29, 2016

(54) BIDIRECTIONAL STABILIZER

(71) Applicant: ALASKAN ENERGY RESOURCES, INC., Anchorage, AK (US)

(72) Inventors: Lee Morgan Smith, Anchorage, AK (US); Betty A. Eastup-Smith, Anchorage, AK (US)

(73) Assignee: ALASKAN ENERGY RESOURCES, INC., Anchorage, AK (US)

( * ) Notice: Subject to any disclaimer, the term of this patent is extended or adjusted under 35 U.S.C. 154(b) by 0 days.

(21) Appl. No.: 14/802,104

(22) Filed: Jul. 17, 2015

Related U.S. Application Data

(60) Provisional application No. 62/069,456, filed on Oct. 28, 2014.

(51) Int. Cl.

| | |
|---|---|
| ***E21B 10/30*** | (2006.01) |
| ***E21B 17/10*** | (2006.01) |
| ***E21B 3/00*** | (2006.01) |
| ***E21B 4/16*** | (2006.01) |
| ***E21B 7/04*** | (2006.01) |
| ***E21B 10/26*** | (2006.01) |
| ***E21B 17/22*** | (2006.01) |

(52) U.S. Cl.
CPC . *E21B 10/30* (2013.01); *E21B 3/00* (2013.01); *E21B 4/16* (2013.01); *E21B 7/04* (2013.01); *E21B 10/26* (2013.01); *E21B 17/1078* (2013.01); *E21B 17/22* (2013.01)

(58) Field of Classification Search
CPC ..... E21B 10/30; E21B 10/26; E21B 17/1078; E21B 17/22
See application file for complete search history.

(56) References Cited

U.S. PATENT DOCUMENTS

| | | | | |
|---|---|---|---|---|
| RE19,339 | E * | 10/1934 | Vertson | E21B 10/16 175/347 |
| 3,285,678 | A | 11/1966 | Garrett et al. | |
| 3,322,217 | A * | 5/1967 | Cook | E21B 10/26 175/323 |
| 3,420,323 | A | 1/1969 | Owens | |
| 4,081,203 | A * | 3/1978 | Fuller | E21B 17/1078 175/325.4 |
| 4,231,437 | A | 11/1980 | Swersky et al. | |
| 4,277,869 | A * | 7/1981 | Hartwell | B23P 15/00 166/173 |
| 4,385,669 | A | 5/1983 | Knutsen | |
| 4,610,316 | A | 9/1986 | Boaz | |
| 4,664,206 | A * | 5/1987 | Butler | E21B 17/22 175/325.2 |
| 5,330,016 | A * | 7/1994 | Paske | E21B 10/00 175/320 |
| 7,650,952 | B2 | 1/2010 | Evans et al. | |
| 8,162,081 | B2 | 4/2012 | Ballard et al. | |
| 8,607,900 | B1 * | 12/2013 | Smith | E21B 10/26 175/323 |
| 9,145,746 | B1 * | 9/2015 | Smith | E21B 17/1078 |

(Continued)

FOREIGN PATENT DOCUMENTS

WO 2013167954 A1 11/2013

*Primary Examiner* — Shane Bomar
(74) *Attorney, Agent, or Firm* — Buskop Law Group, PC; Wendy Buskop

(57) ABSTRACT

A bidirectional stabilizer and a drill string wherein the bidirectional stabilizer reduces motion while rotating into and out of a wellbore. The bidirectional stabilizer can be coupled on a first shaft end to the drill string and on a second shaft end to a bottom hole assembly or other downhole equipment. The bidirectional stabilizer can have an annulus configured for maximum wellbore fluid flow. A cutting portion can be formed on a shaft with a plurality of blades between the first shaft end and the second shaft end. The plurality of blades of the cutting portion can be on a first plane and a plurality of cutting nodes can be on a second plane for smoothing a wellbore.

20 Claims, 2 Drawing Sheets

(56) References Cited

U.S. PATENT DOCUMENTS

| | | | | |
|---|---|---|---|---|
| 9,151,118 | B2 * | 10/2015 | Robson | E21B 10/26 |
| 9,151,119 | B1 * | 10/2015 | Smith | E21B 10/26 |
| 2010/0051349 | A1 * | 3/2010 | Ballard | E21B 10/26 175/57 |
| 2011/0253457 | A1 * | 10/2011 | Shen | E21B 10/42 175/397 |
| 2012/0255786 | A1 | 10/2012 | Isenhour | |
| 2014/0202770 | A1 * | 7/2014 | Zaki | E21B 10/26 175/57 |
| 2014/0246247 | A1 * | 9/2014 | Smith | E21B 10/26 175/394 |

* cited by examiner

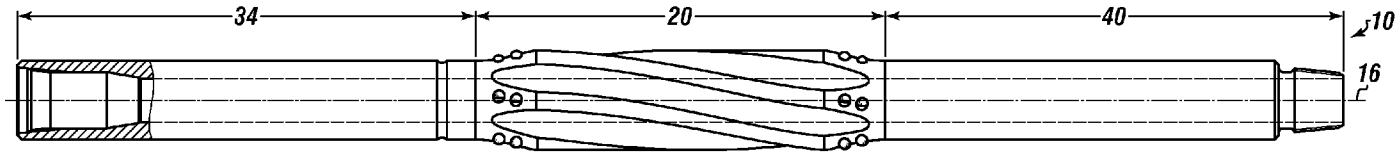
FIGURE 1
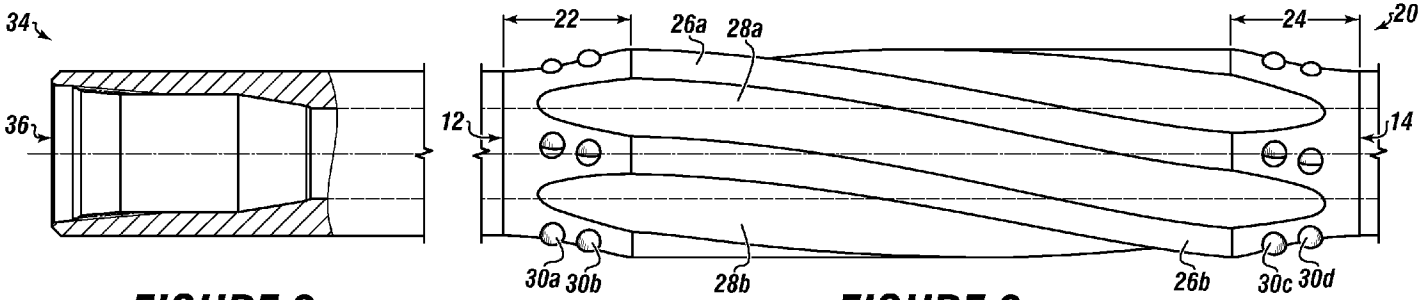
FIGURE 2
FIGURE 3
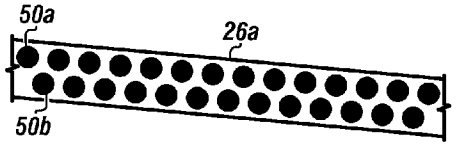
FIGURE 5
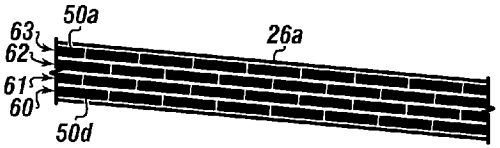
FIGURE 6
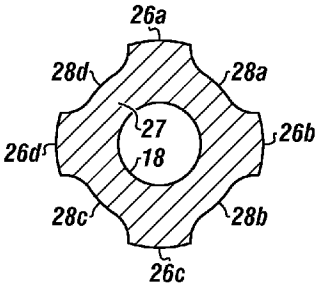
FIGURE 4

BIDIRECTIONAL STABILIZER

CROSS REFERENCE TO RELATED APPLICATION

The current application claims priority to and the benefit of U.S. Provisional Patent Application Ser. No. 62/069,456 filed on Oct. 28, 2014, entitled "BIDIRECTIONAL STABILIZER". This reference is hereby incorporated in its entirety.

FIELD

The present embodiments generally relate to a bidirectional stabilizer.

BACKGROUND

A need exists for a stabilizer for a drill string that can additionally smooth and improve quality of a wellbore bidirectionally.

The present embodiments meet this need.

BRIEF DESCRIPTION OF THE DRAWINGS

The detailed description can be better understood in conjunction with the accompanying drawings as follows:

FIG. 1 depicts a side view of a bidirectional stabilizer according to one or more embodiments.

FIG. 2 depicts an end portion of the bidirectional stabilizer according to one or more embodiments.

FIG. 3 depicts a cutting portion of the bidirectional stabilizer according to one or more embodiments.

FIG. 4 depicts a cut view of the cutting portion according to one or more embodiments.

FIG. 5 depicts a detailed view of a surface of an embodiment of a blade according to one or more embodiments.

FIG. 6 depicts a detailed view of a surface of another embodiment of a blade according to one or more embodiments.

Figure 7:
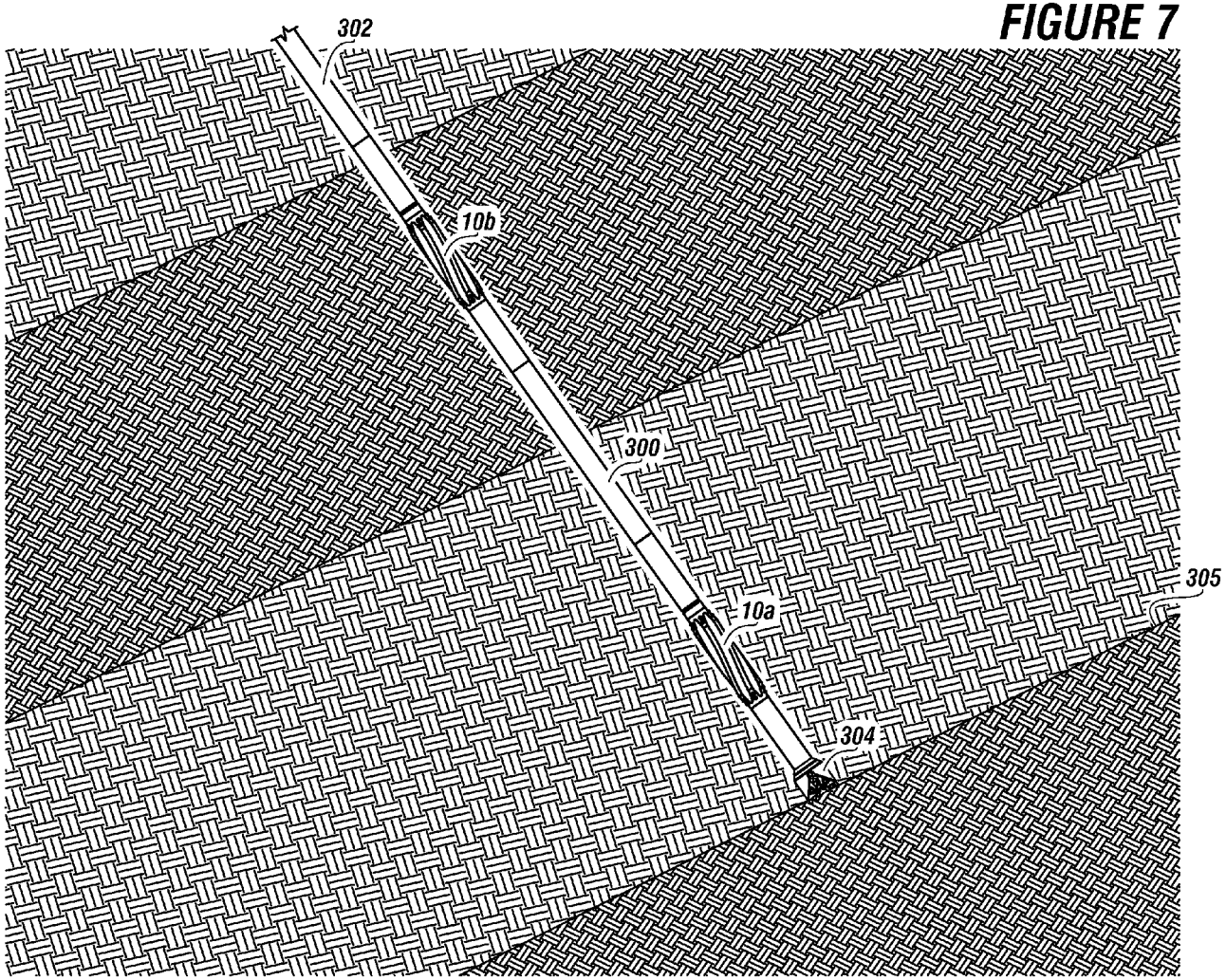
FIG. 7 shows a downhole drill string in the wellbore according to one or more embodiments.

The present embodiments are detailed below with reference to the listed Figures.

DETAILED DESCRIPTION OF THE EMBODIMENTS

Before explaining the present apparatus in detail, it is understood that the apparatus is not limited to the particular embodiments and that it can be practiced or carried out in various ways.

The embodiments generally relate to a bidirectional stabilizer that stabilizes a drill string while rotating into and out of a wellbore.

The embodiments generally relate to a drill string with at least one bidirectional stabilizer secured thereto. In the embodiments, the drill string can support up to 3 bidirectional stabilizers per drill string.

The present embodiments generally relate to a bidirectional stabilizer that additionally increases a wellbore diameter and improves the quality of the wellbore while simultaneously stabilizing a drill string.

The bidirectional stabilizer can be coupled on a first shaft end to the drill string and on a second shaft end to a bottom hole assembly or other downhole equipment. The bidirectional stabilizer can have the first shaft end and the second shaft end centered around a longitudinal axis.

The bidirectional stabilizer can have an annulus configured for maximum wellbore fluid flow. A cutting portion can be formed on a shaft with blades of a plurality of blades between the first and second shaft ends. The plurality of blades of the cutting portion can be on a first plane and a plurality of cutting nodes can be on a second plane, such as from 10 degrees to 30 degrees from the longitudinal axis of the stabilizer.

In the embodiments, two different bidirectional stabilizers can be used on the same drill string.

The bidirectional stabilizer can improve safety at the well site by reducing the number of trips into a well to solve the problem of drift in the diameter of the wellbore.

The bidirectional stabilizer can be directed to an apparatus that simultaneously stabilizes the drill string while reaming a wellbore device, which in turn can save the environment by reducing the number of trips by a bottom hole assembly out of a wellbore.

The embodiments can also minimize the possibility that wellbore fluid and other material from drilling a wellbore can explode out of a wellbore by minimizing the number of trips from the wellbore.

The bidirectional stabilizer can allow a wellbore that cannot be smooth to be smoothed out, which in turn can prevent damage to packers being sent down the wellbore.

This bidirectional stabilizer can be a device that allows a user to ream a wellbore without jeopardizing the integrity of the casing.

The bidirectional stabilizer can connect to a drill string, a bit coupled to the drill string and/or a bottom hole assembly coupled to the drill string. The bidirectional stabilizer can be coupled to the drill string between the bottom hole assembly and tubulars that make up the drill string.

In the embodiments, the bidirectional stabilizer can be a 26 inch outer diameter bidirectional stabilizer or a 3 inch outer diameter bidirectional stabilizer.

The bidirectional stabilizer can have a cutting portion with the plurality of blades extending radially from the shaft.

The cutting portion can have a plurality of cutting inserts installed adjacent the plurality of cutting nodes. In the embodiments, the plurality of cutting inserts can be tungsten carbide inserts, or other suitable materials used for drilling wellbores.

In the embodiments, the plurality of cutting inserts can be in the shape of circles, rectangles, ellipses, or other suitable shapes as required by a specific application.

In the embodiments, the bidirectional stabilizer can have two cutting portions.

Turning now to the Figures, FIG. 1 depicts a side view of a bidirectional stabilizer according to one or more embodiments.

The bidirectional stabilizer 10 can include a shaft with a longitudinal axis 16. The longitudinal axis can be the axis of rotation of the shaft. The bidirectional stabilizer can be a centric bidirectional stabilizer that allows the axis of rotation of the shaft to be same as the center of axis of rotation for the drill pipe or tubulars forming a drill string.

The bidirectional stabilizer can have a nose portion 40, an end portion 34 and a cutting portion 20. The end portion 34 can have a stab end for receiving a stab from the drill string. The nose portion can engage a bottom hole assembly, another drill pipe or tubular of a drill string, a drill bit, measurement while drilling equipment, or rotary steering downhole drilling motors.

In the embodiments, the nose portion can have an outer diameter ranging from 3 inches to 36 inches and an inner diameter that can be identical or substantially equivalent to the end portion. The inner diameter can be from 1 inch to 3 inches.

In other embodiments, the nose portion and the end portion can have the same inner diameters for flow through of wellbore fluid.

In the embodiments, the cutting portion 20 can have an outer diameter that can be from 1 percent to 25 percent larger in diameter than the outer diameter of the nose portion or the outer diameter of the end portion.

In the embodiments, the outer diameter of the cutting portion 20 can be in a plane different from the outer diameter of the nose portion 40 or the outer diameter of the end portion 34.

The cutting portion 20 can be between the nose portion 40 and the end portion 34.

FIG. 2 depicts the end portion 34 with a stab end 36 in more detail according to one or more embodiments.

The stab end 36 can be configured to receive components from the bottom hole assembly, such as a collar or the like, made of nickel alloys, primarily composed of nickel and copper, with small amounts of iron, manganese, carbon, and silicon or a MONEL® collar.

FIG. 3 depicts the cutting portion 20 of the bidirectional stabilizer according to one or more embodiments.

The cutting portion 20 can have a first shaft end 12 and a second shaft end 14.

In the embodiments, the first and second shaft ends can be threaded.

An annulus can be formed longitudinally through the first and second shaft ends. The annulus can be configured for maximum wellbore fluid flow.

A first cutting segment 22 can extend at a first angle from the first shaft end 12. The first angle can range from 10 degrees to 30 degrees from the longitudinal axis, forming a slightly larger outer diameter for the first cutting segment as the first cutting segment extends away from the first shaft end 12.

A second cutting segment 24 can extend at a second angle from the second shaft end 14. The second angle can range from 10 degrees to 30 degrees from the longitudinal axis forming a slightly larger outer diameter for the second cutting segment as the second cutting segment extends away from the second shaft end 14.

A plurality of blades 26*a* and 26*b* can extend identically from each of the first and second shaft ends in a flat plane for enhanced stability of the drill string, reducing wobble.

In the embodiments, the plurality of blades can be longitudinally connected between the first and second cutting segments in a plane parallel to the longitudinal axis.

In the embodiments, the plurality of blades can be straight blades or helical blades.

A plurality of flutes 28*a* and 28*b* can be used, wherein each flute of the plurality of flutes can be formed between each pair of blades of the plurality of blades. Each flute of the plurality of flutes can be tapered on each end. The depth of each flute of the plurality of flutes can be from 10 percent to 50 percent of the outer diameter of the overall bidirectional stabilizer.

For example, for a 6 inch outer diameter bidirectional stabilizer, the trough or flute of the plurality of flutes can range in depth from 4 and ⅞ inches to 6 inches.

For this type of drilling application, all of the drilling components can be made up with a high strength or "premium" connection. The bidirectional stabilizer uses a unique flute depth while still providing a strong high strength premium connection, for example, this bidirectional stabilizer can provide an XT 39, 4 and ½ inch connection.

The flute depth can be as deep as possible to ensure a maximum flow of drill cuttings without clogging, while simultaneously providing a high strength premium connection.

Each flute of the plurality of flutes 28*a* can be formed between a pair of blades of the plurality of blades 26*a* and 26*b*. Each flute of the plurality of flutes 28*b* can be formed between a different pair of blades of the plurality of blades.

A plurality of cutting nodes 30*a* and 30*b* can be on the first cutting segment 22 as the first cutting segment 22 increases in diameter toward the plurality of blades. The plurality of blades are shown as helical blades in this Figure.

The plurality of cutting nodes 30*c* and 30*d* can be on the second cutting segment 24 as the second cutting segment 24 increases in diameter toward the plurality of blades.

The plurality of cutting nodes can have a diameter ranging from ⅜ of an inch to 1 inch.

In the embodiment, the plurality of cutting nodes can extend from the surface of the first and second cutting segments from 0.1 inch to 0.5 inches.

In the embodiments, the plurality of cutting nodes can be polycrystalline diamond compacts, or other suitable materials used for drilling wellbores.

FIG. 4 depicts a cut view of the cutting portion with the plurality of blades, the plurality of flutes and the annulus.

The plurality of blades 26*a*-26*d* are shown as straight blades in this Figure. The plurality of blades can be formed on the outer surface of a shaft 27.

In the embodiments, the plurality of blades can have identical sizes. In the embodiments, the plurality of blades can have different thicknesses.

In the embodiments, when helical blades are used, the helical blades can have identical sizes. In the embodiments, the helical blades can have different thicknesses.

The plurality of flutes 28*a*-28*d* can be located between pairs of blades of the plurality of blades.

As measured from the outer surface of the shaft 27, the thickness of each blade of the plurality of blades can have an identical thickness for this concentric bidirectional stabilizer.

An annulus 18 is also shown.

FIG. 5 depicts a detailed view of a surface of an embodiment of a blade of the plurality of blades according to one or more embodiments.

In the embodiments, the blade of the plurality of blades 26*a* can have a plurality of cutting inserts 50*a* and 50*b* disposed thereon. The plurality of cutting inserts in this embodiment are shown as a circular shape.

In the embodiments, the plurality of cutting inserts can be arranged on the blade of the plurality of blades in an alternating arrangement. While the plurality of cutting inserts are shown as circular, other embodiments can make use of any suitable shape for the plurality of cutting inserts.

The plurality of cutting inserts can range in diameter, if circular from ⅛ inch to 1 inch. In the embodiments, up to 150 cutting inserts can be installed on the blade of the plurality of blades.

A portion of the plurality of cutting inserts can be installed adjacent the plurality of cutting nodes at the ends of the blades of the plurality of blades.

In other embodiments, the plurality of cutting inserts can range from 15 cutting inserts per inch to 50 cutting inserts per inch.

The plurality of cutting inserts can be rectangular in shape and arranged in an alternating configuration on the blade of the plurality of blades.

FIG. 6 depicts a detailed view of a surface of another embodiment of a blade of the plurality of blades according to one or more embodiments.

The blade of the plurality of blades 26*a* can have a plurality of cutting inserts 50*a* and 50*d* disposed thereon. The plurality of cutting inserts in this embodiment are shown as a rectangular shape and configured in an alternating arrangement.

The plurality of cutting inserts can be arranged in parallel rows 60, 61, 62 and 63 with a first row 60 offset from a second row 61.

This Figure shows that the plurality of cutting inserts can have a shape other than a circular shape, such as a rectangular shape, and be arranged in an alternating configuration on the blade of the plurality of blades.

In the embodiments, the bidirectional stabilizer can be made from either steel or a non-magnetic material.

In the embodiments, the plurality of cutting inserts can be installed on at least one edge of at least one blade of the plurality of blades. In the embodiments, at least one cutting insert to 30 cutting inserts per blade can be used.

In the embodiments, the bidirectional stabilizer can be modular.

In the embodiments, the bidirectional stabilizer excluding the plurality of cutting nodes can be an integral one piece bidirectional stabilizer formed from a single piece of metal.

In embodiments, the plurality of blades can be formed from a material harder than material used to form the first shaft end, the shaft and the second shaft end.

In embodiments, the plurality of blades can be pretreated with nitride to improve hardness and create a more durable bidirectional stabilizer.

FIG. 7 shows a downhole drill string in the wellbore according to one or more embodiments.

FIG. 7 depicts the bidirectional stabilizers connected to the first and second drill pipe segments forming the drill string that protects the drill pipe.

The downhole drill string can have at least one bidirectional stabilizer 10*a* mounted between a bottom hole assembly 304 and a first drill pipe segment 300.

In this embodiment, the downhole drill string is shown with an additional bidirectional stabilizer 10*b* mounted between the first drill pipe segment 300 and a second drill pipe segment 302

The downhole drill string is shown in the wellbore surrounding a formation 305.

In embodiments, the bidirectional stabilizer can be a 60 inch long bidirectional stabilizer or a 15 inch long bidirectional stabilizer, or a 20 inch long bidirectional stabilizer. When the bidirectional stabilizer is of a short length, the bidirectional stabilizer can be installed every 100 feet of drill pipe. When such short versions of the bidirectional stabilizer are used, 3 to 20 bidirectional stabilizers can be used, and a few can even be stacked through the bottom hole assembly.

With a slightly larger outer diameter, the formation can rub on the bidirectional stabilizer and not on the drill pipe.

In long wells, ranging from 1 mile to 20 miles in length, the bidirectional stabilizer can simultaneously perform as a sacrificial node while centralizing the drill string and protecting the more expensive drill pipe.

While these embodiments have been described with emphasis on the embodiments, it can be understood that within the scope of the appended claims, the embodiments might be practiced other than as specifically described herein.

What is claimed is:

1. A bidirectional stabilizer for stabilizing a drill string while reaming into and out of a wellbore, the bidirectional stabilizer comprising:

a. a shaft connected between a first shaft end and a second shaft end, wherein the shaft comprises an outer diameter;

b. the first shaft end and the second shaft end centered around a longitudinal axis;

c. an annulus formed longitudinally through the shaft, wherein the annulus is configured for maximum wellbore fluid flow;

d. a cutting portion formed on an outer surface of the shaft, the cutting portion comprising:

(i) a first cutting segment extending at a first angle from the first shaft end, the first angle ranging from 10 degrees to 30 degrees from the longitudinal axis forming a slightly larger outer diameter for the first cutting segment as the first cutting segment extends away from the first shaft end;

(ii) a second cutting segment extending at a second angle from the second shaft end, the second angle ranging from 10 degrees to 30 degrees from the longitudinal axis forming a slightly larger outer diameter for the second cutting segment as the second cutting segment extends away from the second shaft end;

(iii) a plurality of blades longitudinally connected between the first cutting segment and the second cutting segment, each blade of the plurality of blades can have an identical length, each blade of the plurality of blades existing in a plane parallel to the longitudinal axis, wherein the first cutting segment has a cutting segment length from 5 percent to 35 percent of the length of the plurality of blades, the second cutting segment has a cutting segment length from 5 percent to 35 percent of the length of the plurality of blades, each blade of the plurality of blades comprising a smooth blade surface;

(iv) a plurality of flutes formed between pairs of blades of the plurality of blades, wherein the depth of each flute of the plurality of flutes is from 10 percent to 50 percent of the outer diameter; and (v) a plurality of cutting nodes installed on at least one edge of the first cutting segment and on at least one edge of the second cutting segment; and wherein an end portion and a nose portion range in length from 25 percent to 35 percent of a total length of the bidirectional stabilizer, and the bidirectional stabilizer couples on the end portion to the drill string and on the nose portion to a bottom hole assembly and the bidirectional stabilizer has a symmetrical configuration.

2. The bidirectional stabilizer of claim 1, wherein the nose portion is connected to the second shaft end for engaging the bottom hole assembly, a tubular or another drill pipe of the drill string, a drill bit, measurement while drilling equipment, rotary steering downhole drilling motors, or combinations thereof.

3. The bidirectional stabilizer of claim 1, wherein the end portion is connected to the first shaft end comprising a stab end for receiving a stab from the drill string.

4. The bidirectional stabilizer of claim 1, wherein the plurality of blades are straight blades or helical blades.

5. The bidirectional stabilizer of claim 1, comprising a plurality of cutting inserts installed on at least one edge of at least one blade of the plurality of blades.

6. The bidirectional stabilizer of claim 5, wherein the plurality of cutting inserts range from 1 cutting insert per blade to 150 cutting inserts per blade.

7. The bidirectional stabilizer of claim 5, wherein a portion of the plurality of cutting inserts are installed adjacent the plurality of cutting nodes at the ends of each of the blades of the plurality of blades on the first cutting segment, the second cutting segment or both the first cutting segment and the second cutting segment.

8. The bidirectional stabilizer of claim 5, wherein the plurality of cutting inserts range from 15 cutting inserts per inch to 50 cutting inserts per inch.

9. The bidirectional stabilizer of claim 5, wherein the plurality of cutting inserts are rectangular in shape and arranged in an alternating configuration on each of the blades of the plurality of blades.

10. The bidirectional stabilizer of claim 5, wherein the plurality of cutting inserts are arranged in parallel rows, wherein a first row is offset from a second row.

11. The bidirectional stabilizer of claim 5, wherein the plurality of cutting inserts are circular in shape and arranged in an alternating configuration on each of the blades of the plurality of blades.

12. The bidirectional stabilizer of claim 1, wherein the bidirectional stabilizer is made from either steel or a non-magnetic material.

13. The bidirectional stabilizer of claim 1, wherein the bidirectional stabilizer is modular.

14. The bidirectional stabilizer of claim 1, wherein the bidirectional stabilizer, excluding the plurality of cutting nodes, is an integral one piece bidirectional stabilizer formed from a single piece of metal.

15. The bidirectional stabilizer of claim 1, wherein the plurality of blades are formed from a material harder than material used to form the first shaft end, the shaft and the second shaft end.

16. The bidirectional stabilizer of claim 15, wherein the plurality of blades are pretreated with nitride to improve hardness.

17. A downhole drill string in a wellbore comprising:

a. a first drill pipe segment;

b. a second drill pipe segment;

c. a bottom hole assembly; and d. at least one bidirectional stabilizer mounted between the bottom hole assembly and the first drill pipe segment, mounted between the first drill pipe segment and the second drill pipe segment, or mounted between both the bottom hole assembly and the first drill pipe segment and the first drill pipe segment and the second drill pipe segment, wherein the at least one bidirectional stabilizer comprises:

(i) a shaft connected between a first shaft end and a second shaft end, wherein the shaft comprises an outer diameter;

(ii) the first shaft end and the second shaft end centered around a longitudinal axis;

(iii) an annulus formed longitudinally through the shaft, wherein the annulus is configured for maximum wellbore fluid flow; and (iv) a cutting portion formed on an outer surface of the shaft, the cutting portion comprising:

1. a first cutting segment extending at a first angle from the first shaft end, the first angle ranging from 10 degrees to 30 degrees from the longitudinal axis forming a slightly larger outer diameter for the first cutting segment as the first cutting segment extends away from the first shaft end;

2. a second cutting segment extending at a second angle from the second shaft end, the second angle ranging from 10 degrees to 30 degrees from the longitudinal axis forming a slightly larger outer diameter for the second cutting segment as the second cutting segment extends away from the second shaft end;

3. a plurality of blades longitudinally connected between the first cutting segment and the second cutting segment, each blade of the plurality of blades can have an identical length, each blade of the plurality of blades existing in a plane parallel to the longitudinal axis, wherein the first cutting segment has a cutting segment length from 5 percent to 35 percent of the length of the plurality of blades, the second cutting segment has a cutting segment length from 5 percent to 35 percent of the length of the plurality of blades, each blade of the plurality of blades comprising a smooth blade surface;

4. a plurality of flutes formed between pairs of blades of the plurality of blades, wherein the depth of each flute of the plurality of flutes is from 10 percent to 50 percent of the outer diameter; and 5. a plurality of cutting nodes installed on at least one edge of the first cutting segment and on at least one edge of the second cutting segment forming the at least one bidirectional stabilizer with a symmetrical configuration.

18. The bidirectional stabilizer of claim 17, wherein the plurality of blades are straight blades or helical blades.

19. The bidirectional stabilizer of claim 17, comprising a plurality of cutting inserts installed on at least one edge of at least one blade of the plurality of blades.

20. The bidirectional stabilizer of claim 17, wherein an end portion and a nose portion range in length from 25 percent to 35 percent of a total length of the at least one bidirectional stabilizer.

* * * * *